US007612489B2

(12) United States Patent
Park et al.

(10) Patent No.: US 7,612,489 B2
(45) Date of Patent: Nov. 3, 2009

(54) DISPLAY FILTER, DISPLAY DEVICE INCLUDING THE DISPLAY FILTER, AND METHOD OF MANUFACTURING THE DISPLAY FILTER

(75) Inventors: Dae-chul Park, Suwon-si (KR); Yong-won Choi, Seoul (KR); Sang-cheol Jung, Seongnam-si (KR); Wang-kyu Choi, Gunpo-si (KR)

(73) Assignee: Samsung Corning Precision Glass Co., Ltd., Jinpyeong-dong, Gumi (KR)

( * ) Notice: Subject to any disclaimer, the term of this patent is extended or adjusted under 35 U.S.C. 154(b) by 471 days.

(21) Appl. No.: 11/129,303

(22) Filed: May 16, 2005

(65) Prior Publication Data

US 2005/0253493 A1 Nov. 17, 2005

(30) Foreign Application Priority Data

May 17, 2004 (KR) ..... 10-2004-0034862

(51) Int. Cl.

| | |
|---|---|
| ***H01J 17/49*** | (2006.01) |
| ***H01K 1/26*** | (2006.01) |
| *H01J 5/16* | (2006.01) |
| *H01K 1/30* | (2006.01) |

(52) U.S. Cl. ..... 313/112; 345/7; 430/231

(58) Field of Classification Search ..... None
See application file for complete search history.

(56) References Cited

U.S. PATENT DOCUMENTS

| | | | | |
|---|---|---|---|---|
| 5,804,102 | A * | 9/1998 | Oi et al. | 252/587 |
| 6,013,983 | A * | 1/2000 | Asano et al. | 313/581 |
| 6,991,849 | B2 * | 1/2006 | Oya | 428/353 |
| 2002/0050783 | A1 * | 5/2002 | Kubota et al. | 313/495 |
| 2003/0063241 | A1 * | 4/2003 | Matsumoto et al. | 349/110 |
| 2005/0225240 | A1 * | 10/2005 | Min et al. | 313/582 |

* cited by examiner

*Primary Examiner*—Sikha Roy
*Assistant Examiner*—Tracie Green
(74) *Attorney, Agent, or Firm*—Lee & Morse, P.C.

(57) ABSTRACT

A display filter for use with a plurality of microlenses in a display system includes an external light and electromagnetic (EM)-shielding portion having a photosensitive transparent resin layer with a photocatalyst, and an external light and EM-shielding pattern formed on regions of the photosensitive transparent resin layer to prevent external light from entering the display system and to prevent EM waves generated in the display device from exiting the display device, the regions corresponding to boundaries between the plurality of microlenses.

25 Claims, 7 Drawing Sheets

DISPLAY FILTER, DISPLAY DEVICE INCLUDING THE DISPLAY FILTER, AND METHOD OF MANUFACTURING THE DISPLAY FILTER

BACKGROUND OF THE INVENTION

1. Field of the Invention

The present invention relates to a display filter, a display device including the display filter, and a method of manufacturing the display filter. More particularly, the present invention relates to a display filter that enhances contrast of a display device viewed in a bright room, a display device including the display filter, and a method of manufacturing the display filter.

2. Description of the Related Art

As modern society becomes more information-oriented, the technology of photoelectronic devices and apparatuses is advancing, and these devices are becoming widespread. In particular, image display devices are in widespread use in devices such as TV screens and PC monitors. Thinly built wide screens have become mainstream display devices.

In particular, a plasma display panel (PDP) is gaining popularity as a next-generation display device to replace a cathode ray tube (CRT) because it is thin, has a large screen, and can be readily fabricated. A PDP device displays images based on a gas discharge phenomenon, and exhibits superior display characteristics, e.g., a high display capacity, high brightness and contrast, free from after-image, and a wide viewing angle.

In a PDP device, when a direct current (DC) or alternating current (AC) voltage is applied to electrodes, a gas plasma discharge occurs that produces ultraviolet (UV) light. The UV emission excites adjacent phosphors to emit visible light.

Despite the above advantages, PDPs have several problems associated with driving characteristics, including an increase in electromagnetic (EM) radiation, near-infrared (NIR) emission, phosphor surface reflection, and an obscured color purity due to orange light emitted from helium (He) or xenon (Xe) that is used as a sealing gas.

The EM radiation generated by PDPs may adversely affect humans and cause electronic devices, e.g., wireless telephones or remote controls, to malfunction. Thus, in order to use such PDPs, there is a need to reduce the EM radiation emitted from the PDPs to a predetermined level or less, e.g., by shielding. Various PDP filters have been used for such shielding, as well as to reduce unwanted reflections and to enhance color purity. For example, various PDP filters having an EM shielding function, a NIR wave shielding function, an antireflection (AR) function, and a color purity enhancing function, can be used with PDPs.

Conventional PDP filters include an adhesive layer and a conductive metal layer. The adhesive layer is a transparent film having EM shielding properties, good adhesion, fluidity in predetermined conditions, and exhibiting a screening effect. The conductive metal layer is a film that is geometrically patterned by microlithography and has an aperture ratio exceeding 50%.

However, conventional PDP filters cannot prevent external light from entering a panel assembly, leading to reduction in contrast in bright viewing conditions. This external light may interfere with light emitted from a discharge cell in the panel assembly, thereby lowering contrast, ultimately degrading the image displayed on the PDPs.

SUMMARY OF THE INVENTION

The present invention is therefore directed to a display filter, a display device including the display filter, and a method of manufacturing the display filter, which substantially overcome one or more of the problems due to the limitations and disadvantages of the related art.

It is a feature of an embodiment of the present invention to provide a display filter that can enhance contrast of a display device in a bright room.

It is another feature of an embodiment of the present invention to provide a display filter that can enhance an EM shielding property.

It is yet another feature of an embodiment of the present invention to provide a method for readily manufacturing such a display filter.

It is still another feature of an embodiment of the present invention to provide a display device using such a display filter.

At least one of the above and other features and advantages of the present invention may be realized by providing a display filter for use with a plurality of microlenses in a display system, the display filter including an external light and electromagnetic (EM) shielding portion including a photosensitive transparent resin layer and an external light and EM-shielding pattern, the photosensitive transparent resin layer having a photocatalyst, the external light and EM-shielding pattern formed on regions of the photosensitive transparent resin layer to prevent external light from entering the display system and to prevent EM waves generated in the display system from exiting the display system, the regions corresponding to boundaries between the plurality of microlenses.

The display filter further may include a filter base on which the photosensitive transparent resin layer is formed. The filter base may have at least one of an antireflection property, an orange light-shielding property, and a near-infrared-shielding property. The filter base may have a multi-layered structure, and the photosensitive transparent resin layer may be formed on the entire surface of any one of the layers of the filter base. The multi-layered structure may include a transparent substrate and at least one layer having an antireflection property, an orange light-shielding property, and/or a near-infrared-shielding property. The plurality of microlenses may be on the filter base or on a support attached to the filter base.

The external light and EM-shielding pattern may be a stripe pattern or a mesh pattern. The display filter may include a core pattern on activated portions of the photosensitive transparent resin layer, the external light and EM-shielding pattern being on the core pattern. The core pattern may be Pd, Au, Ag, Pt, or a combination thereof. The external light and EM-shielding pattern may be metal, metal oxide or metal sulfide. A metal film pattern may be provided on the external light and EM-shielding pattern.

The external light and EM-shielding portion may further include thereon at least one layer having an antireflection property, an orange light-shielding property, and/or a near-infrared-shielding property.

At least one of the above and other features and advantages of the present invention may be realized by providing the display filter in a display device including a panel assembly and the plurality of microlenses between the panel assembly and the display filter.

At least one of the above and other features and advantages of the present invention may be realized by providing a method of manufacturing a display filter for use with a plurality of microlenses in a display system, the method including forming a photosensitive transparent resin layer having a photocatalyst, and forming an external light and electromagnetic EM-shielding pattern on regions of the photosensitive transparent resin layer to prevent external light from entering the display system and to prevent EM waves generated in the display system from exiting the display system, the regions corresponding to boundaries between the plurality of microlenses.

Forming the photosensitive transparent resin layer may include providing a photosensitive transparent resin on an entire surface of a filter base. Forming the external light and electromagnetic EM-shielding pattern may include electrolessly plating a core pattern on the photosensitive transparent layer and providing external light and EM-shielding material on the core pattern.

Forming the external light and EM-shielding portion may further include providing a water-soluble polymer layer on the photosensitive transparent resin layer before electrolessly plating the core pattern. The water-soluble polymer layer may be at least one material selected from the group consisting of polyvinylalcohol, polyvinylphenol, polyvinylpyrrolidone, polyacrylic acid, polyacrylamide, gelatin, and a copolymer thereof.

The electrolessly plating the core pattern may include providing a mask adjacent the photosensitive transparent resin in accordance with the regions, and exposing the photosensitive transparent resin to provide an activated photocatalyst in the regions.

BRIEF DESCRIPTION OF THE DRAWINGS

The above and other features and advantages of the present invention will become more apparent to those of skilled in the art by describing in detail exemplary embodiments thereof with reference to the attached drawings in which.

DETAILED DESCRIPTION OF THE INVENTION

Figure 1:
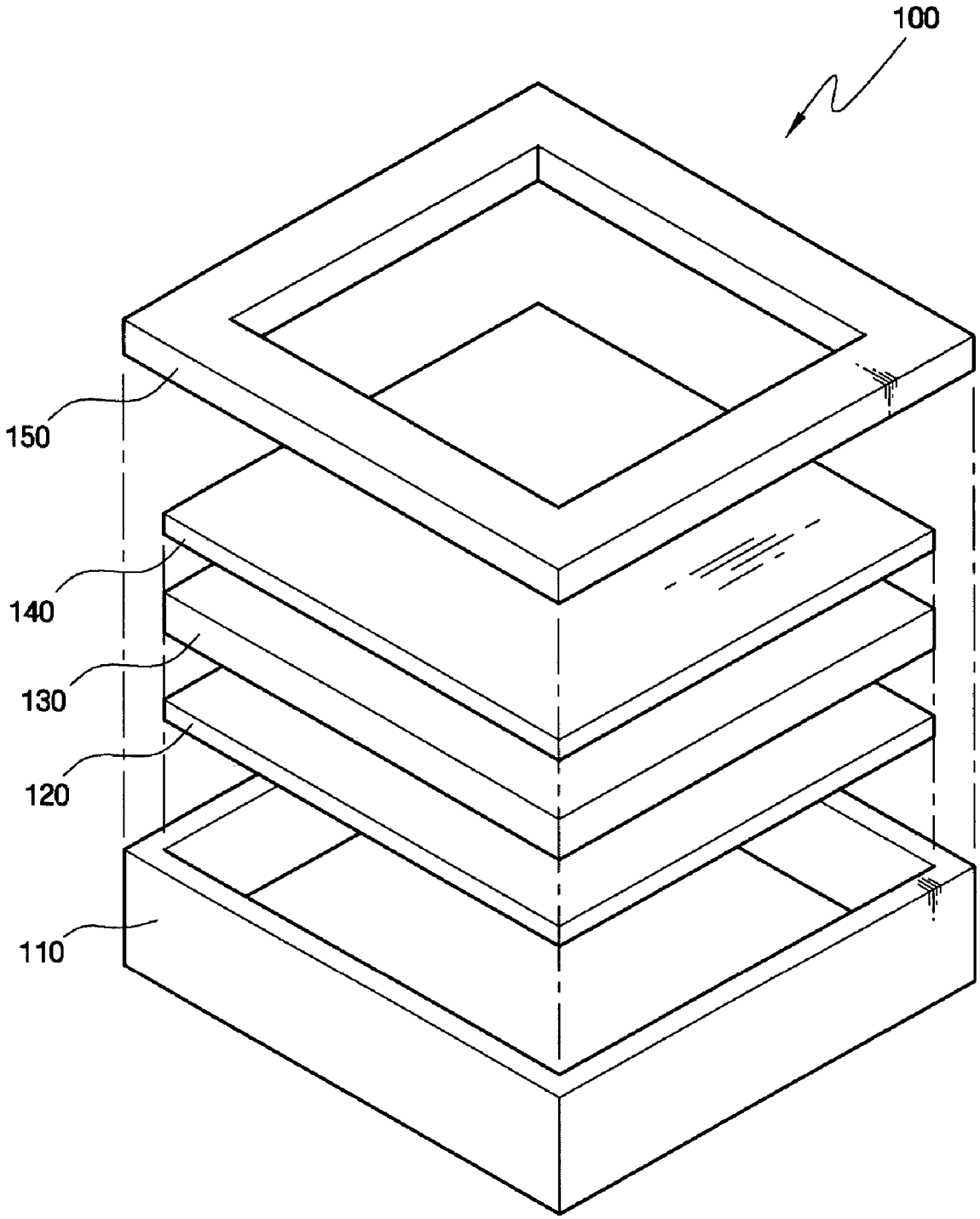
FIG. 1 illustrates an exploded perspective view of a plasma display panel (PDP) according to an embodiment of the present invention.

Korean Patent Application No. 10-2004-0034862, filed on May 17, 2004, in the Korean Intellectual Property Office, and entitled: "Display Filter, Display Device including the Display Filter, and Method of Manufacturing the Display Filter," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. It will also be understood that when a layer is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout the specification.

Hereinafter, display filters, display devices including these display filters, and methods of manufacturing these display filters according to embodiments of the present invention will be described with reference to the accompanying drawings. A plasma display panel (PDP) and a PDP filter will be illustrated hereinafter by way of example. However, it will be understood by those of ordinary skill in the art that the present invention can also be applied similar technologies such as a Field Emission Display (FED), a FED filter, a Surface-conduction Electron-emitter Display (SED), and a SED filter.

FIG. 1 illustrates an exploded perspective view of a PDP 100 according to an embodiment of the present invention.

Referring to FIG. 1, the PDP 100 includes a case 110, a cover 150 covering an upper surface of the case 110, a driving circuit board 120 received in the case 110, a panel assembly 130 including discharge cells, and a PDP filter 140. The PDP filter 140 includes a conductive layer made of a material with good conductivity on a transparent substrate. The conductive layer is grounded to the case 110 via the cover 150.

Hereinafter, a PDP filter for filtering electromagnetic (EM) waves, e.g., orange light and near-infrared (NIR) light, will first be described, and a PDP including this filter and a panel assembly will then be described.

Figure 2:
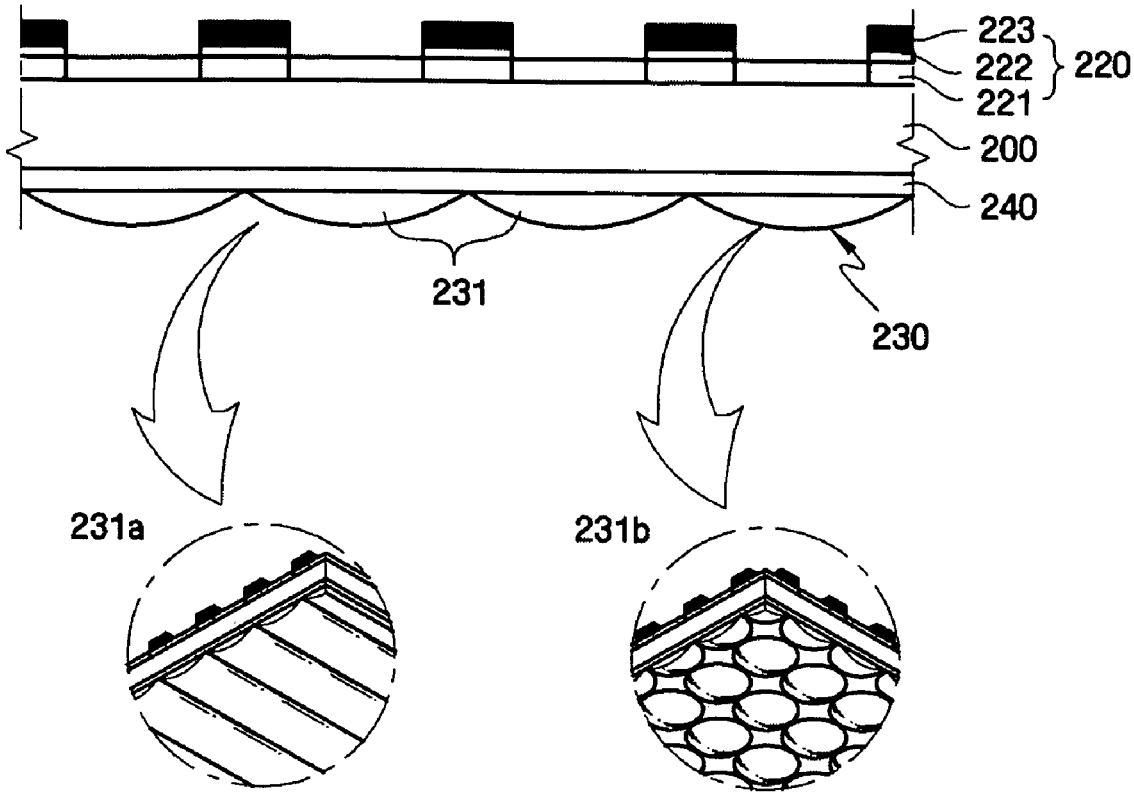
FIG. 2 illustrates a cross-sectional view of a PDP filter according to a first embodiment of the present invention.

FIG. 2 illustrates a cross-sectional view of a PDP filter according to a first embodiment of the present invention.

Referring to FIG. 2, the PDP filter of the first embodiment includes a filter base 200 and an external light and EM-shielding portion 220 formed on a surface of the filter base 200. A light-focusing portion 230 may be formed on a surface of the filter base 200 opposite the external light and EM-shielding portion 220. A support 240 for the light-focusing portion 230 may also be included.

The light-focusing portion 230 faces the panel assembly 130, shown in FIG. 1, and focuses light generated from the panel assembly. The light-focusing portion 230 may include of a plurality of microlenses 231.

The external light and EM-shielding portion 220 prevents both external light from entering the panel assembly and specific EM waves from exiting the panel assembly. The external light and EM-shielding portion 220 may formed in a stripe pattern or a mesh pattern. The external light and EM-shielding portion 220 may have a pattern corresponding to the pattern of the plurality of microlenses 231, at least in one direction thereof.

The external light and EM-shielding portion 220 may include a photosensitive transparent resin layer 221, an electrolessly plated core pattern 222 formed on the photosensitive transparent resin layer 221, and an external light and EM-shielding pattern 223 formed on the electrolessly plated core pattern 222.

The photosensitive transparent resin layer 221 may be made of a polymer containing a photocatalyst, e.g, a vinyl alcohol resin, an acrylic resin, or a cellulosic resin. The vinyl alcohol resin may be an ethylene-vinyl alcohol copolymer or a vinylacetate-vinylalcohol copolymer. The acrylic resin may be polyacrylamide, polymethylolacrylamide, or a copolymer thereof. The cellulosic resin may be nitrocellulose, acetylpropyl cellulose, or acetylbutyl cellulose.

There are two types of photocatalysts used for the photosensitive transparent resin layer 221: a negative type and a positive type. The negative-type photocatalyst is activated after being exposed to light, thereby generating photoelectrons. The positive-type photocatalyst is in an activated state before being exposed to light, and is inactivated after being exposed to light. The negative-type photocatalyst may be titanium oxide ($TiO_2$) or a $TiO_2$ precursor, and the positive-type photocatalyst may be tin chloride ($SnCl_2$). Photocatalyst selection will be described in detail later.

The electrolessly plated core pattern 222 is formed by electroless plating of a material containing cations capable of reacting with activated electrons in the photosensitive transparent resin layer 221. The electrolessly plated core pattern 222 may be made of palladium (Pd), gold (Au), silver (Ag), platinum (Pt), or a combination thereof.

The external light and EM-shielding pattern 223 is formed on the electrolessly plated core pattern 222, and prevents external light from entering the panel assembly and undesired EM waves generated by the display from exiting the panel assembly. The external light and EM-shielding pattern 223 is made of a material capable of EM-shielding, e.g., a metal, a metal oxide or a metal sulfide. The metal may be nickel (Ni) or chromium (Cr); the metal oxide may be indium oxide, chromium oxide, tin oxide, silver oxide, cobalt oxide, mercury oxide, or iridium oxide; and the metal sulfide may be chromium sulfide, palladium sulfide, nickel sulfide, copper sulfide, cobalt sulfide, iron sulfide, tantalum sulfide, or titanium sulfide.

The external light and EM-shielding pattern 223 also decreases reflectivity in order to prevent a visibility reduction due to light reflection. The external light and EM-shielding pattern 223 may have a reflectivity between about 0.5 to 1. Generally, reflectivity refers to average reflectivity with respect to light in the visible wavelength range.

The microlenses 231 focus light from the panel assembly. To increase an emission efficiency of visible light generated from discharge cells (not shown) facing a lower surface of the PDP filter, the microlenses 231 are disposed to correspond to the discharge cells. Since the light-focusing portion 230 focuses visible light generated from the discharge cells, the visible light can be efficiently used.

The microlenses 231 can take any form as long as they can efficiently focus visible light generated from the discharge cells. For example, the microlenses 231 may be embossed or engraved. In detail, the microlenses 231 may be cylindrical embossed microlenses 231*a* or convex embossed microlenses 231*b*, as shown in an enlarged bottom perspective view circled in FIG. 2, respectively. The microlenses 231 may also be a combination (not shown) of a cylindrical embossed and a convex embossed microlens. The cylindrical emboss type microlenses 231*a* are preferable when the external light and EM-shielding pattern 223 is a striped pattern. The convex emboss type microlenses 231*b* can be used when the external light and EM-shielding pattern 223 is a meshed pattern or a striped pattern. The microlenses 231 may be arranged at a constant interval from one another.

In the above-described embodiment, the light-focusing portion 230 is interposed between the filter base 200 and an underlying panel assembly (not shown), although the position of the light-focusing portion 230 is not limited thereto. For example, the light-focusing portion 230 may also be disposed in the filter base 200. In the above-described embodiment, the light-focusing portion 230 is attached to the filter base 200 by the support 240. However, the light-focusing portion 230 may also be directly attached to a surface of the filter base 200. The support 240 and the light-focusing portion 230 may also be integral. A thickness of the support 240 can be adjusted as needed.

The support 240 may be a film made of a resin transparent to UV light, e.g., polyethylene terephthalate (PET), polycarbonate (PC), or polyvinylchloride (PVC). Alternatively, the support 240 may be an orange light-shielding layer, a NIR-shielding layer, or an AR layer.

There is a correlation between the shapes and positions of the external light and EM-shielding portion 220 and the light-focusing portion 230. Specifically, the radius of curvature of the microlenses 231 is adjusted according to the distance between the external light and EM-shielding pattern 223 and the light-focusing portion 230. The external light and EM-shielding pattern 223 may be positioned between adjacent microlenses 231, i.e., in a periphery of each microlens 231.

The numerical aperture (NA) of the microlenses 231 is adjusted by adjusting the linewidth of the external light and EM-shielding pattern 223, thereby further efficiently preventing external light from entering the discharge cells (not shown). A pattern pitch of the external light and EM-shielding pattern 223 is optimized according to the distance between the panel assembly and the PDP filter, the size of discharge cells, and/or the radius of curvature and pitch of the microlenses 231.

The filter base 200 may simply be a transparent substrate that transmits light generated from a panel assembly, or may have AR, orange light-shielding and/or NIR-shielding properties or layer(s) having such properties stacked with or without a transparent substrate.

Figure 3:
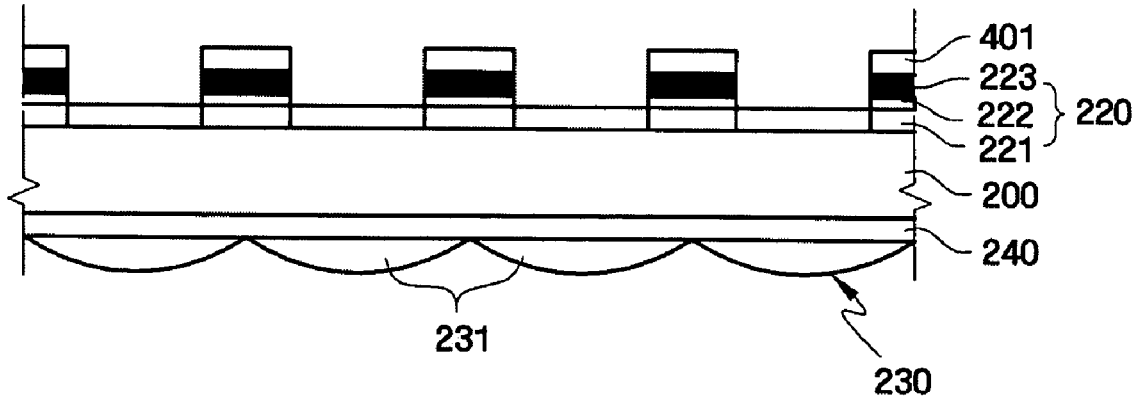
FIG. 3 illustrates a cross-sectional view of a PDP filter according to a second embodiment of the present invention.

FIG. 3 illustrates a cross-sectional view of a PDP filter according to a second embodiment of the present invention. The second embodiment shown in FIG. 3 differs from the first embodiment in that the PDP filter further includes a metal film pattern 401 on the external light and EM-shielding portion 220.

The metal film pattern 401 makes the PDP filter more efficient at EM-shielding. Thus, a material for the metal film pattern 401 is not particularly limited, as long as it is made of a metal having conductivity sufficient to shield an EM wave. For example, the metal film pattern 401 may be copper, silver, nickel, iron, chromium, an alloy or it may be a multi-layered metal film pattern.

The thickness of the metal film pattern 401 may be in the range from about 0.1 to 50 microns. If the thickness of the metal film pattern 401 exceeds about 50 microns, pattern precision may be degraded. On the other hand, if it is less than about 0.1 microns, minimal conductivity for an EM wave-shielding effect may not be obtained. The metal used for the metal film pattern 401 may be the same as that used for the external light and EM-shielding pattern 223.

Figure 4:
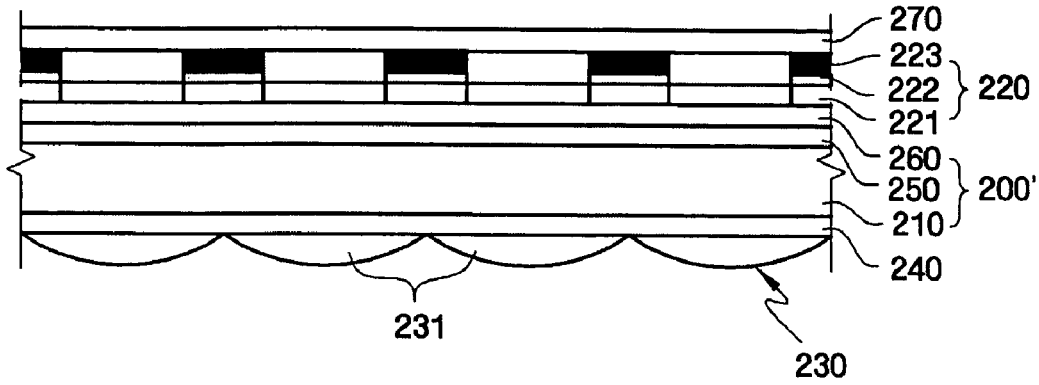
FIG. 4 illustrates a cross-sectional view of a PDP filter according to a third embodiment of the present invention.

FIG. 4 illustrates a cross-sectional view of a PDP filter according to a third embodiment of the present invention. The third embodiment is different from the first and second embodiments in that a filter base 200' has a multi-layered structure. In the particular example shown in FIG. 4, the filter base 200' is a sequentially stacked structure including a transparent substrate 210, an orange light-shielding layer 250, and a NIR-shielding layer 260. The external light and EM-shielding portion 220 is provided on this multi-layered structure 200', and an AR layer 270 is provided on the external light and EM-shielding portion 220.

Figure 5:
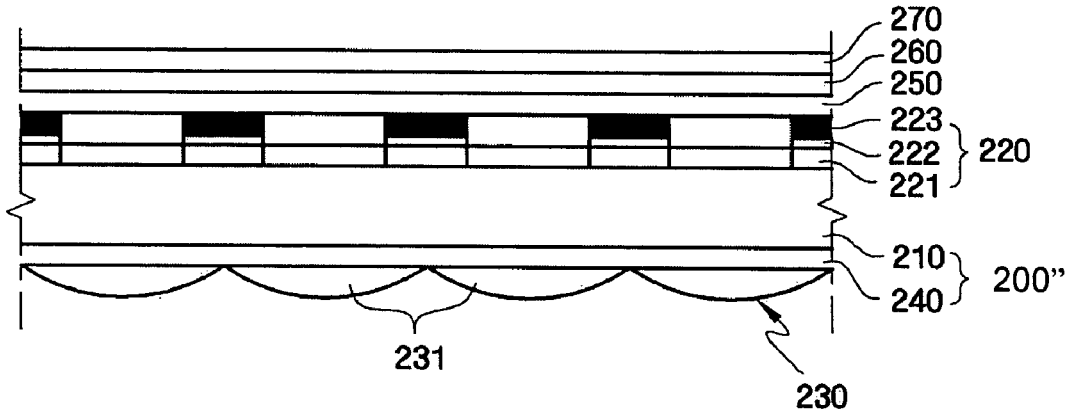
FIG. 5 illustrates a cross-sectional view of a PDP filter according to a fourth embodiment of the present invention.

FIG. 5 illustrates a cross-sectional view of a PDP filter according to a fourth embodiment of the present invention. Referring to FIG. 5, the filter base 200" is just the transparent substrate 210. The external light and EM-shielding portion 220 is on the transparent substrate 210, and the orange light-shielding layer 250, the NIR-shielding layer 260, and the AR layer 270 are sequentially stacked on external light and EM-shielding portion 220.

The stacking sequence of the orange light-shielding layer 250, the NIR-shielding layer 260, and the AR layer 270 may be modified, but it is preferable that the AR layer 270 be in the topmost position. Additional orange light-shielding, NIR-shielding, and/or AR layers may also be included.

Material used for the transparent substrate 210 is not particularly limited, as long as provided that it has a visible light transmittance of about 80% or more, good thermal resistance, and sufficient strength. For example, the transparent substrate 210 may be made of an inorganic compound such as tempered or semi-tempered glass or quartz, or a transparent polymer material. Examples of the transparent polymer material include, but are not limited to, polyethylene terephthalate (PET), polysulfone, polyethersulfone (PES), polystyrene (PS), polyethylenenaphthalate, polyacrylate, polyetheretherketone (PEEK), polycarbonate (PC), polypropylene (PP), polyimide, triacetyl cellulose (TAC), and polymethylmethacrylate (PMMA). It may be preferable to use PET when considering cost, thermal resistance, and transparency. The thickness of the transparent substrate 210 may be in the range from about 2.0 to 3.5 mm.

When red visible light emitted from plasma in the panel assembly appears as orange light, the orange light-shielding layer 250 color corrects the orange light into red light. For color correction, it is preferable that visible light emitted from plasma is traverses the orange light-shielding layer 250 and then the NIR-shielding layer 260, rather than in the opposite order. Thus, it is more efficient to arrange the orange light-shielding layer 250 to be closer to the panel assembly. According to third and fourth embodiments shown in FIGS. 4 and 5, respectively, the NIR-shielding layer 260 and the orange light-shielding layer 250 are separate layers. However, a hybrid film having both a NIR-shielding and an orange light-shielding property may also be used.

The orange light-shielding layer 250 uses a colorant having a selective absorptivity capable of absorbing an unfavorable emission of 580 to 600 nm orange light in order to improve both the color reproduction of the display and screen sharpness. The colorant may be a dye or a pigment. The colorant may be an organic colorant having an orange light-shielding property, such as anthraquinone, cyanine, azos, stilbene, phthalocyanine, and methine, but the present invention is not limited thereto. The type and concentration of the colorant are not defined herein since they are determined by an absorption wavelength, an absorption coefficient, and transmission characteristics required by a particular display.

The NIR-shielding layer 260 prevents strong NIR radiation from exiting the panel assembly, since such NIR radiation may cause electronic devices to malfunction.

The AR layer 270 reduces external light reflections in order to improve visibility. Thus, the AR layer 270 is generally formed on the NIR-shielding layer 260, but the present invention is not limited thereto. It is preferable that the AR layer 270 be formed such that it is positioned on the display side, i.e. adjacent to the cover. The AR layer 270 may also be formed to be adjacent to the panel assembly, thereby efficiently reducing external light reflections. Reducing external light reflections enhances the transmittance of visible light emitted from the panel assembly. The AR layer 270 may also be formed on a substrate by coating or printing using an AR film, or by a variety of generally known film formation methods. Alternatively, the AR layer 270 may be formed by attaching an arbitrary transparent mold having an AR film or an AR transparent structure to a desired position using a transparent adhesive or bond.

Specifically, the AR layer 270 may be a ¼ wavelength mono-layered film made of a material having a low refractive index in the visible range, e.g., about 1.5 or less, or, more preferably, about 1.4 or less. Such materials include a fluorine-based transparent polymer resin, magnesium fluoride, a silicon-based resin, and silicon oxide. The AR layer 270 may also be a multi-layered film made of two or more inorganic compounds with different refractive indices such as metal oxide, fluoride, silicide, boride, carbide, nitride, or sulfide, or it may be made of two or more organic compounds with different refractive indices such as a silicon-based resin, an acrylic resin, or a fluorine-based resin.

When the AR layer 270 is formed as a mono-layered film, it is easy to manufacture, but it does not provide a sufficient AR effect over a broad wavelength range compared to a multi-layered AR film. For example, the AR layer 270 may be an alternately stacked structure having a low refractive index film, e.g., $SiO_2$, and a high refractive index film, e.g., $TiO_2$ or $Nb_2O_5$.

In the PDP filter according to the embodiment shown in FIG. 5, as the distance between the external light and EM-shielding portion 220 and the light-focusing portion 230 decreases, the radius of curvature of the microlenses 231 of the light-focusing portion 230 can be made proportionately smaller. The light-focusing portion 230 may be adjacent to the display filter 140, attached to the transparent substrate 210 via the support 240, or directly formed on the transparent substrate 210.

While PDP filters according to several particular embodiments of the present invention have been described with reference to the drawings, the invention is not limited to those particular embodiments and a variety of combinations of those embodiments are possible. Moreover, variations of those particular embodiments may be practiced by those of ordinary skill in the art.

Hereinafter, a method for forming the external light and EM-shielding portion in the PDP filter according to the second embodiment of the present invention shown in FIG. 3 is discussed in detail. FIGS. 6A through 6F illustrate cross-sectional views of stages in an embodiment of a method for forming the external light and EM-shielding portion.

Figure 6A:
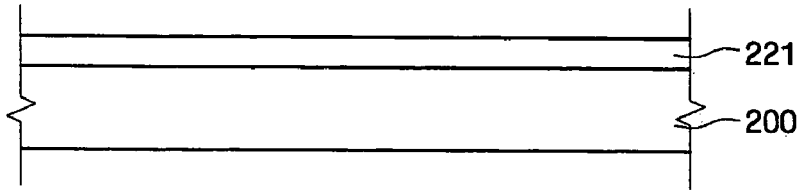
FIGS. 6A through 6F illustrate cross-sectional views of stages in a method of forming an external light and EM-shielding portion as shown in FIG. 3 according to an embodiment of the present invention.

Referring to FIG. 6A, the photosensitive transparent resin layer 221 is formed on an entire surface of the filter base 200.

The photosensitive transparent resin layer 221 may be a polymer material containing a photocatalyst. Preferably, the polymer material used for the photosensitive transparent resin layer 221 is a vinyl alcohol resin, an acrylic resin, or a cellulosic resin. For example, the vinyl alcohol resin may be an ethylene-vinyl alcohol copolymer or a vinyl acetate-vinyl alcohol copolymer. The acrylic resin may be polyacrylamide, polymethylol acrylamide, or a copolymer thereof. The cellulosic resin may be nitrocellulose, acetylpropyl cellulose, or acetylbutyl cellulose. The photocatalyst used for the photosensitive transparent resin layer 221 may be a negative-type or a positive-type photocatalyst, as discussed above.

When a predetermined region of the photosensitive transparent resin layer 221 is selectively exposed to light via a mask (described later), only the photocatalyst in the predetermined region of the photosensitive transparent resin layer 221 is activated or inactivated. Thus, an electrolessly plated core pattern and an external light and EM-shielding pattern can be formed on a predetermined region of the photosensitive transparent resin layer 221.

For example, a $TiO_2$ precursor is appropriately diluted with butanol or propanol and then mixed with a polymer to be used as the photocatalyst for the photosensitive transparent resin layer 221. The ratio of the $TiO_2$ precursor to butanol or propanol may be less than about 20% to 80%. The photocatalyst may be a commercially available product, e.g., Tyzor® (DuPont).

The photosensitive transparent resin layer 221 may be coated on the transparent substrate 210 by spin-coating, roll-coating, dipping, or bar-coating. For example, the photosensitive transparent resin layer 221 may be coated by spin-coating using a spin coater spinning at a speed of 1,000 to 3,000 rpm.

The thickness of the photosensitive transparent resin layer 221 may vary according to UV irradiation durations and wavelengths. However, it is quite important to consider various processing parameters when choosing an optimal photosensitive transparent resin layer 221 thickness.

Figure 6B:
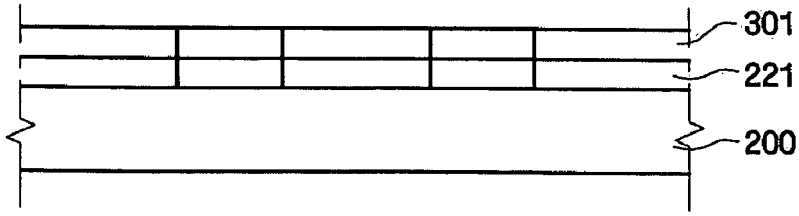

Referring to FIG. 6B, a water-soluble polymer layer 301 is formed on the photosensitive transparent resin layer 221. The water-soluble polymer refers to a photoresist that can be removed by an aqueous solution. The water-soluble polymer may be at least one selected from the group consisting of polyvinylalcohol (PVA), polyvinylphenol, polyvinylpyrrolidone, polyacrylic acid, polyacrylamide, gelatin, and a copolymer thereof, but it is not limited thereto.

The photocatalyst of the photosensitive transparent resin layer 221 forms a photoelectron-activated or a photoelectron-inactivated region according to its type during an exposure process (described later). The water-soluble polymer 301 permits photoelectrons to have greater energy and to be more easily produced in the photosensitive transparent resin layer 221. The forming of the water-soluble polymer layer 301 is an optional step, and thus may be omitted.

Figure 6C:
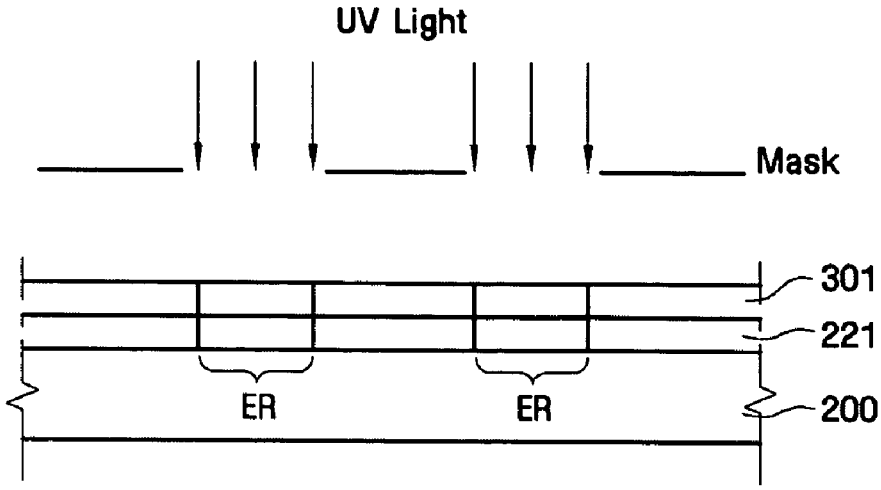
Figure 6D:
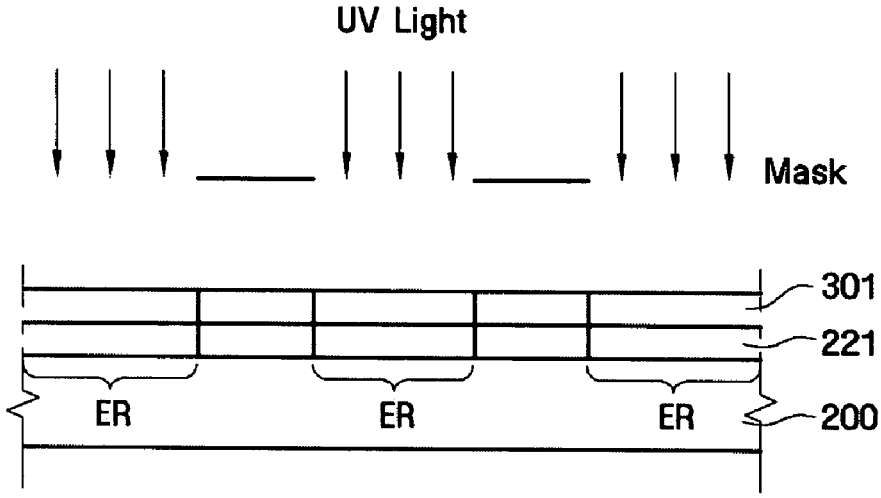

Referring to FIGS. 6C and 6D, a region intended for an external light and EM-shielding pattern is first defined. Then, predetermined regions of the water-soluble polymer layer 301 and the photosensitive transparent resin layer 221 are exposed to UV light through a mask defining a stripe or mesh pattern.

When a negative-type photocatalyst is used, as shown in FIG. 6C, the photocatalyst is activated in exposed regions ER intended for pattern formation. When a positive-type photocatalyst is used, as shown in FIG. 6D, regions other than those intended for pattern formation are exposed and the photocatalyst is activated in the non-exposed regions. An activated photocatalyst generates photoelectrons. When the photocatalyst is activated, the photoelectrons are changed from a ground state to an excited state and are capable of easily combining with positive charges. For UV irradiation, a lamp with a broad wavelength range may be used, but a short-wavelength lamp, e.g., an I-line or a G-line lamp may be used.

Hereinafter, subsequent steps in an exposure process using a negative-type photocatalyst will be described.

Figure 6E:
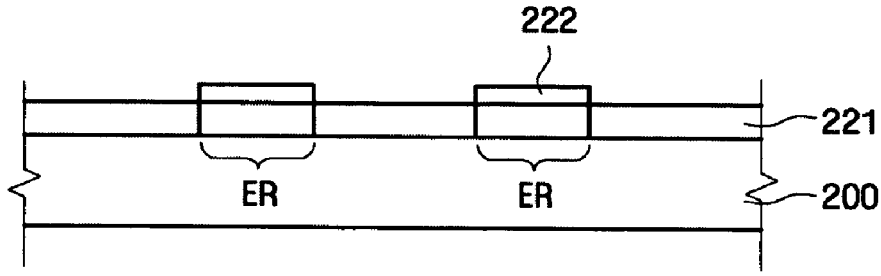

Referring to FIG. 6E, after an exposure process, the filter base 200, on which the photosensitive transparent resin layer 221 and the water-soluble polymer layer 301 are formed, is dipped in an aqueous catalyst solution for electroless plating. The aqueous catalyst solution is an aqueous metal solution capable of generating positive charges. When the filter base 200 is dipped in the aqueous catalyst solution, a reduction reaction is induced by recombination of photoelectrons generated by the UV irradiation and positive charges in the aqueous catalyst solution. Through the reduction reaction, a positively charged metal is adsorbed by the photoelectron-activated regions in the photosensitive transparent resin layer 221 to form the electrolessly plated core pattern 222. At this time, the water-soluble polymer layer 301 is dissolved in the aqueous catalyst solution. The aqueous catalyst solution may be a chloride solution containing Pd, Au, Ag, Pt, or a combination thereof.

Since the electrolessly plated core pattern 222 is formed only on exposed regions ER of the photosensitive transparent resin layer 221, non-exposed regions of the photosensitive transparent resin layer 221 can sufficiently maintain the desired transparency. Alternatively, the non-exposed regions may be removed.

Figure 6F:
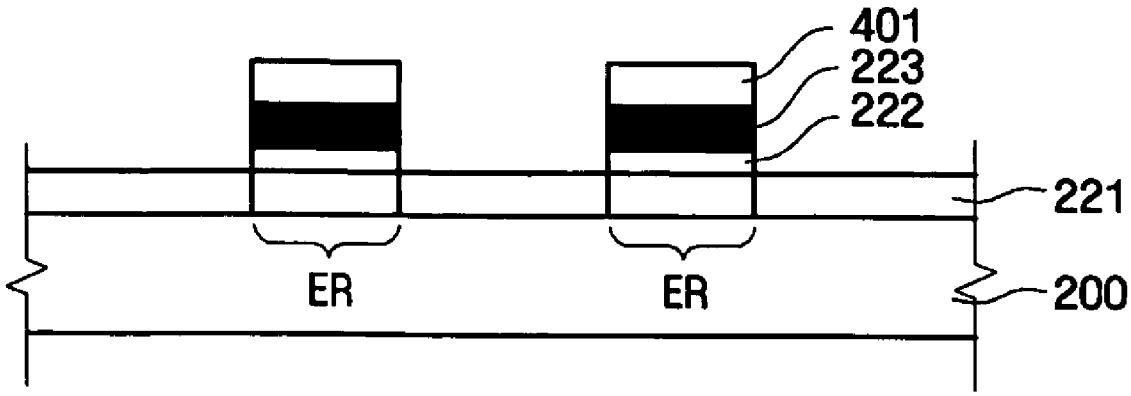

Referring to FIG. 6F, the external light and EM-shielding pattern 223, which is an electrolessly plated pattern made of metal, metal oxide, or metal sulfide, is formed on the electrolessly plated core pattern 222. The external light and EM-shielding pattern 223 may be formed by deposition, e.g., vacuum deposition, sputtering, or ion-plating. The external light and EM-shielding pattern 223 may also be formed by electroplating or electrolessly plating. The external light and EM-shielding pattern 223 formed by vacuum deposition exhibits good adhesion strength and durability. However, electroless plating is preferable due to process simplification. Thus, electroless plating may also be used to form the external light and EM-shielding pattern 223.

The external light and EM-shielding pattern 223 lowers reflectivity to prevent a reduction in visibility due to light reflection. The external light and EM-shielding pattern 223 may have reflectivity of about 1 to 50%. Generally, reflectivity refers to average reflectivity for light in the 400 to 600 nm wavelength range. However, provided that reflectivity has no wavelength dependency, the reflectivity as used herein represents reflectivity for light at a wavelength of 550 nm.

Referring to FIG. 6F, the conductive metal film pattern 401 is formed on the external light and EM-shielding pattern 223 to reinforce the electromagnetic wave-shielding properties of the external light and EM-shielding pattern 223.

The metal film pattern 401 is made of a material having conductivity sufficient to shield an EM wave, such as copper, silver, nickel, iron, or chromium. The metal film pattern 401 may be made of an alloy or it may be a multi-layered metal film pattern. The metal film pattern 401 may be formed by vapor phase precipitation, deposition, sputtering, ion-plating, metal film overcoating, electroless plating, or electroplating.

A photosensitive transparent resin layer of an external light and EM-shielding portion manufactured as described above is formed to cover the entire surface of a filter base, however, this photosensitive transparent resin layer may remain only in the exposed regions ER.

The light-focusing portion may be formed and secured to the display filter as follows. Referring to FIG. 2, a UV curable resin is coated on a surface of the support 240. Then, the support 240 is allowed to pass through a molding roll (not shown) for lens formation; the molding roll has a shape opposite to that of the microlenses 231 on its surface. As a result, the shape of the molding roll is transferred to the UV curable resin coated on the surface of the support. The light-focusing portion 230 is finally formed when the UV curable resin is exposed to UV light, thereby fixing its shape. However, the present invention is not limited to the above-described method for producing the light-focusing portion 230. When the UV curable resin has NIR and/or orange light-shielding property, the light-focusing portion 230 can additionally filter out NIR and/or orange light. Securing of the light-focusing portion and the PDP filter can be completed by attaching the support 240 having the light-focusing portion 230 thereon to the filter base 200. The support 240 may be attached to the filter base 200 by a transparent adhesive or bond such as an acrylic adhesive, a silicon- or urethane-based adhesive, a polyvinylbutyral (PVB) or ethylene-vinyl acetate adhesive (EVA), polyvinylether (PVE), saturated amorphous polyester, or melamine resin.

Hitherto, the PDP filter 140 according to the present invention has been described by way of example. Hereafter, a PDP device including the PDP filter 140 will be described in detail.

Figure 7A:
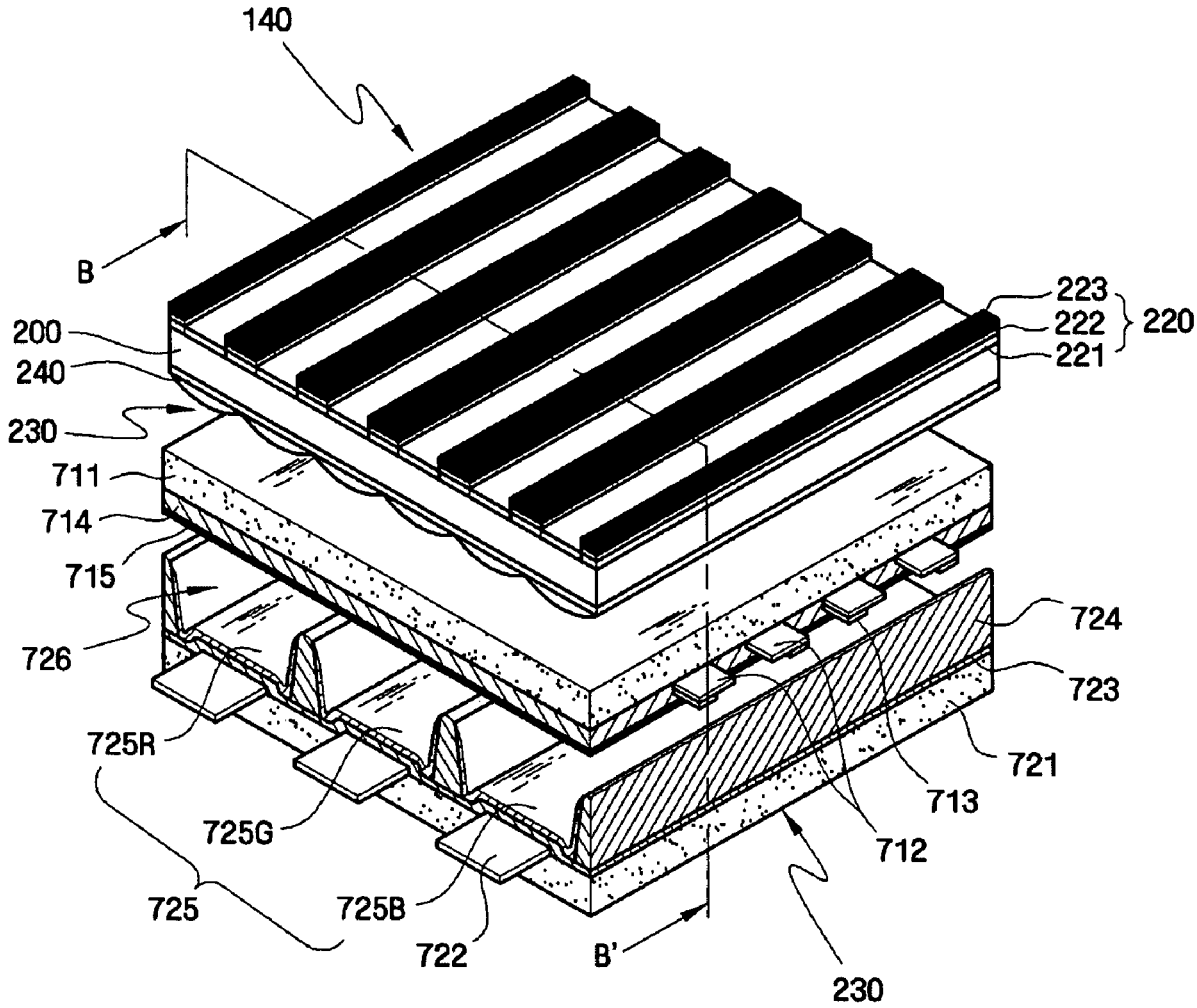
FIG. 7A illustrates a perspective view of a PDP including a PDP filter as shown in FIG. 2 according to an embodiment of the present invention.
Figure 7B:
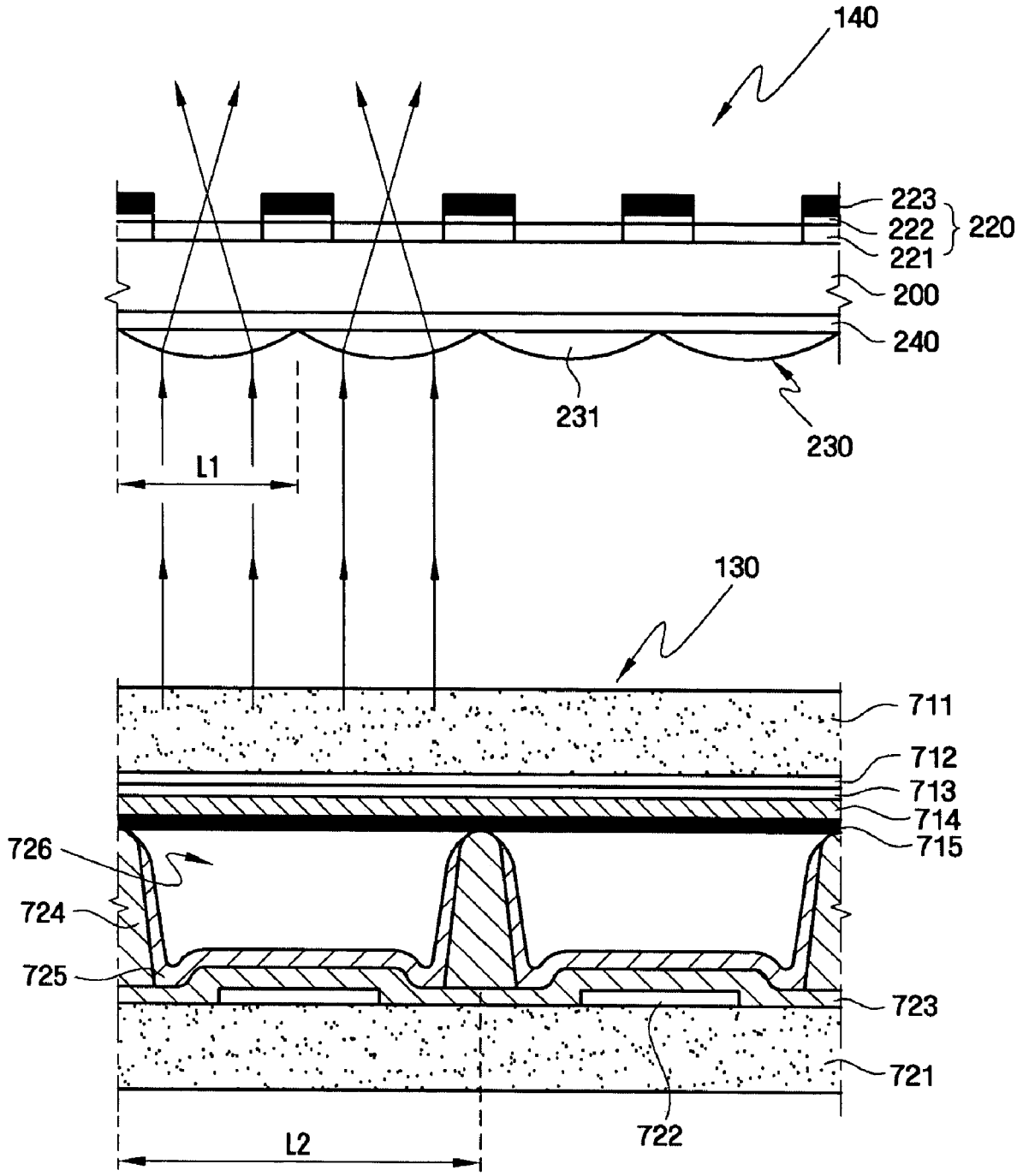
FIG. 7B illustrates a cross-sectional view taken along a line B-B' of FIG. 7A.

FIG. 7A illustrates a perspective view of a PDP device 100 according to an embodiment of the present invention, and FIG. 7B illustrates a cross-sectional view taken along a line B-B' of FIG. 7A, in which the filter of the first embodiment shown in FIG. 2 is used.

Referring to FIGS. 7A and 7B, the PDP device 100 includes a PDP filter 140 and a panel assembly 130. The PDP filter 140 has been illustrated above, and thus, a detailed description thereof will not be given. Hereinafter, the panel assembly 130 will be described in detail.

Referring to FIG. 7A, a plurality of sustain electrode pairs 712 are disposed on a surface of a front substrate 711 in a striped pattern. Each sustain electrode includes a bus electrode 713 to reduce a signal delay. The sustain electrode pairs 712 are entirely covered with a dielectric layer 714. A dielectric protective layer 715 is formed on the dielectric layer 714. According to an embodiment of the present invention, the dielectric protective layer 715 is formed by covering the dielectric layer 714 with magnesium oxide (MgO) using a sputtering method.

A plurality of address electrodes 722 are formed in a striped pattern on a surface of a rear substrate 721 facing the front substrate 711. The address electrodes 722 are formed to intersect with the sustain electrode pairs 712 so that the front substrate 711 and the rear substrate 721 face each other. The address electrodes 722 are wholly covered with a dielectric layer 723. A plurality of partition walls 724 are formed on the dielectric layer 723 in such a way to be parallel to the address electrodes 722 and projected toward the front substrate 711. The partition walls 724 are disposed between address electrodes 722.

A phosphor layer 725 is formed on inside surfaces of grooves defined by the partition walls 724 and the dielectric layer 723. The phosphor layer 725 includes a red phosphor layer 725R, a green phosphor layer 725G, and a blue phosphor layer 725B, which are partitioned by the partition walls 724. The red phosphor layer 725R, the green phosphor layer 725G, and the blue phosphor layer 725B are respectively formed using red, green, and blue phosphor particles by a thick film formation method such as a screen printing method, an inkjet method, or a photoresist film method. For example, the red phosphor layer 725R, the green phosphor layer 725G, and the blue phosphor layer 725B may be made of (Y, Gd)$BO_3$:Eu, $Zn_2SiO_4$:Mn, and $BaMgAl_{10}O_{17}$:Eu, respectively.

Discharge cells 726, which are defined by the grooves and the protective layer 715 when the front substrate 711 and the rear substrate 721 are coupled to each other, are filled with a discharge gas. Thus, the sustain electrode pairs 712 of the front substrate 711 and the address electrodes 722 of the rear substrate 721 intersect with each other in the discharge cells 726 of the panel assembly 130. The discharge gas in these discharge cells may be a Ne—Xe mixed gas or a He—Xe mixed gas.

The panel assembly 130 with the above-described structure emits light according to the same principle as a fluorescent lamp. UV light emitted from the discharge gas of the discharge cells 726 excites the phosphor layer 725 to emit visible light.

The phosphor layers are made of phosphor materials having different visible light conversion efficiencies. Thus, a color balance adjustment for image display is generally performed by adjusting the brightness of the phosphor layers. In detail, based on the phosphor layer with the lowest brightness, the brightness of the other phosphor layers is lowered in accordance with a predetermined ratio.

The driving of the panel assembly 130 is generally classified into driving for address discharge and sustain discharge. The address discharge occurs between the address electrodes 722 and one electrode of the sustain electrode pairs 712. At the same time, wall charges are generated. The sustain discharge occurs due to a potential difference between sustain electrode pairs positioned in the discharge cells 726 in which wall charges are generated. During the sustain discharge, the phosphor layer 725 of the discharge cells 726 in which wall charges are generated is excited by UV light emitted from the discharge gas, and the phosphor layer 725 emits visible light. This visible light creates visually recognizable images.

The relationship between a panel assembly and a PDP filter will now be described with reference to FIG. 7B.

Referring to FIG. 7B, a PDP filter 140 is separated from an upper surface of a front substrate 711 of a panel assembly 130.

The PDP filter 140 includes the external light and EM-shielding portion 220 on the filter base 200 to prevent external light from entering the panel assembly 130. Since the external light is mainly absorbed by, or reflected from external light and EM-shielding pattern 223, excitation of the phosphor layer 725 by external light that has passed through the front substrate 711 is reduced. Therefore, the contrast ratio of the PDP for bright room conditions is enhanced.

Furthermore, the light-focusing portion 230 is formed on a surface of the PDP filter 140 to face the panel assembly 130. The light-focusing portion 230 focuses visible light generated by the discharge cells 726 so that it exits the display device, thereby reducing light loss and enhancing the brightness of the PDP.

As shown in FIG. 7B, when microlenses 231 of the light-focusing portion 230 are cylindrical embossed microlenses, it is preferable to form the microlenses 231 and partition walls 724 to be parallel to each other. In order to more efficiently focus visible light, the boundaries between the microlenses 231 may correspond to the partition walls 724. According to an embodiment of the present invention, it is preferable that the pitch L2 of the partition walls 724 be an integer multiple of the pitch L1 of the microlenses 231. Thus, it is preferable that one or more of the microlenses 231 correspond to a unit cell of the discharge cells 726.

The display filter, display device including the display filter, and the method of manufacturing the display filter according to the present invention provide at least the following advantages.

First, the display filter has an external light and EM-shielding portion, thereby enhancing a contrast ratio of the display device in a bright room.

Secondly, the external light and EM-shielding portion installed in the display filter also enhances an EM wave-shielding property as well as the contrast ratio of the display device.

Thirdly, since a plurality of microlenses is provided between the display filter and the panel assembly, visible light generated from discharge cells can be focused by the microlenses so that it exits the display device, thereby reducing light loss and ultimately enhancing the brightness of the display device. The plurality of microlenses may be adjacent to, attached to or integral with the display filter.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A display filter, comprising:

an external light and electromagnetic (EM) shielding portion including a photosensitive transparent resin layer having a photocatalyst; and an external light and EM-shielding pattern formed on the photosensitive transparent resin layer, the external light and EM-shielding portion being positioned adjacent to a plurality of microlenses focusing light from a panel assembly, the external light and EM-shielding pattern corresponding to boundaries between adjacent microlenses.

2. The display filter as claimed in claim 1, further comprising a filter base on which the photosensitive transparent resin layer is formed.

3. The display filter as claimed in claim 2, wherein the filter base has at least one of an antireflection property, an orange light-shielding property, and a near-infrared-shielding property.

4. The display filter as claimed in claim 2, wherein the filter base is a multi-layered structure, and the photosensitive transparent resin layer is formed on the entire surface of any one of the layers of the filter base.

5. The display filter as claimed in claim 4, wherein the multi-layered structure comprises a transparent substrate and at least one layer having an antireflection property, an orange light-shielding property, and/or a near-infrared-shielding property.

6. The display filter as claimed in claim 2, herein the plurality of microlenses adjacent the external light and EM-shielding portion is on the filter base.

7. The display filter as claimed in claim 2, wherein the plurality of microlenses adjacent the external light and EM-shielding portion is on a support attached to the filter base.

8. The display filter as claimed in claim 1, wherein the external light and EM-shielding pattern is only on a portion of the photosensitive transparent resin layer, the external light and EM-shielding pattern having a stripe pattern or a mesh pattern.

9. The display filter as claimed in claim 1, further comprising a core pattern on activated portions of the photosensitive transparent resin layer, the core pattern being between the transparent resin layer and the external light and EM-shielding pattern.

10. The display filter as claimed in claim 9, wherein the core pattern includes Pd, Au, Ag, Pt, or a combination thereof.

11. The display filter as claimed in claim 1, wherein the external light and EM-shielding pattern includes metal, metal oxide or metal sulfide.

12. The display filter as claimed in claim 11, wherein the external light and EM-shielding pattern includes metal oxide, the metal oxide being indium oxide, chromium oxide, tin oxide, silver oxide, cobalt oxide, mercury oxide, or iridium oxide.

13. The display filter as claimed in claim 11, wherein the external light and EM-shielding pattern includes metal sulfide, the metal sulfide being chromium sulfide, palladium sulfide, nickel sulfide, copper sulfide, cobalt sulfide, iron sulfide, tantalum sulfide, or titanium sulfide.

14. The display filter as claimed in claim 1, further comprising a metal film pattern on the external light and EM-shielding pattern.

15. The display filter as claimed in claim 14, wherein the metal film pattern includes a metal having a conductivity sufficient for EM-shielding.

16. The display filter as claimed in claim 1, further comprising, on the external light and EM-shielding portion, at least one layer having an antireflection property, an orange light-shielding property, and/or a near-infrared-shielding property.

17. A display device, comprising:

a panel assembly;

a display filter having an external light and electromagnetic (EM) shielding portion including a photosensitive transparent resin layer having a photocatalyst, and an external light and EM-shielding pattern formed on the photosensitive transparent resin layer; and a plurality of microlenses between the panel assembly and the display filter, the plurality of microlenses focusing light from the panel assembly, the external light and EM-shielding pattern corresponding to boundaries between adjacent microlenses.

18. A method of manufacturing a display filter, the method comprising:

providing a plurality of microlenses for focusing light generated from a panel assembly;

forming a photosensitive transparent resin layer having a photocatalyst; and forming an external light and electromagnetic EM-shielding pattern corresponding to boundaries between adjacent microlenses.

19. The method as claimed in claim 18, wherein:

forming the photosensitive transparent resin layer includes providing a photosensitive transparent resin on an entire surface of a filter base; and forming the external light and electromagnetic EM-shielding pattern includes electrolessly plating a core pattern on the photosensitive transparent layer, and providing external light and EM-shielding material on the core pattern.

20. The method as claimed in claim 19, wherein the filter base is a multi-layered structure.

21. The method as claimed in claim 19, wherein forming the external light and EM-shielding pattern further comprises providing a water-soluble polymer layer on the photosensitive transparent resin layer before electrolessly plating the core pattern.

22. The method as claimed in claim 21, wherein the water-soluble polymer layer is at least one material selected from the group consisting of polyvinylalcohol, polyvinylphenol, polyvinylpyrrolidone, polyacrylic acid, polyacrylamide, gelatin, and a copolymer thereof.

23. The method as claimed in claim 19, wherein electrolessly plating the core pattern includes providing a mask adjacent the photosensitive transparent resin in accordance with the external light and electromagnetic EM-shielding pattern, and exposing the photosensitive transparent resin to provide an activated photocatalyst.

24. The display filter as claimed in claim 1, wherein the external light and EM-shielding pattern is external to the panel assembly.

25. The display filter as claimed in claim 1, wherein the external light and EM-shielding portion is a single layer configured to block external light and EM radiation generated in the panel assembly.

* * * * *

UNITED STATES PATENT AND TRADEMARK OFFICE

CERTIFICATE OF CORRECTION

PATENT NO. : 7,612,489 B2
APPLICATION NO. : 11/129303
DATED : November 3, 2009
INVENTOR(S) : Park et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 984 days.

Signed and Sealed this

Fourteenth Day of December, 2010

David J. Kappos

David J. Kappos
*Director of the United States Patent and Trademark Office*